US006793013B2

(12) United States Patent
Gounder

(10) Patent No.: US 6,793,013 B2
(45) Date of Patent: Sep. 21, 2004

(54) POLYGONAL HEAT EXCHANGE CHAMBER INCLUDING A TAPERED PORTION LINED WITH WATER TUBE PANELS AND METHOD OF LINING A TAPERED PORTION OF A POLYGONAL HEAT EXCHANGE CHAMBER WITH SUCH PANELS

(75) Inventor: Ponnusami K. Gounder, Easton, PA (US)

(73) Assignee: Foster Wheeler Energy Corporation, Clinton, NJ (US)

( * ) Notice: Subject to any disclaimer, the term of this patent is extended or adjusted under 35 U.S.C. 154(b) by 15 days.

(21) Appl. No.: 10/338,701

(22) Filed: Jan. 9, 2003

(65) Prior Publication Data

US 2004/0134644 A1 Jul. 15, 2004

(51) Int. Cl.[7] ..... F28F 9/26; F28F 13/08; F22B 37/10

(52) U.S. Cl. ..... 165/143; 165/147; 122/235.12; 122/235.22

(58) Field of Search ..... 165/143, 144, 165/145, 146, 147, 104.16, 169, 173, 910; 122/6 A, 235.11, 235.22, 235.12, 235.15, 235.14, 235.23, 235.25

(56) References Cited

U.S. PATENT DOCUMENTS

| | | | | |
|---|---|---|---|---|
| 3,105,466 A | * | 10/1963 | Richard | 122/235.12 |
| 3,797,569 A | * | 3/1974 | Meder et al. | 165/169 |
| 4,476,816 A | * | 10/1984 | Cannon et al. | 122/4 D |
| 4,537,156 A | * | 8/1985 | Rees | 122/6 A |
| 4,546,731 A | * | 10/1985 | Ammann | 122/367.1 |
| 4,576,120 A | | 3/1986 | Ammann | 122/6 |
| 4,726,323 A | * | 2/1988 | Rees | 122/6 A |
| 5,071,057 A | | 12/1991 | Murphy | 228/183 |
| 5,722,353 A | * | 3/1998 | Phelps | 122/6 A |
| 5,775,265 A | | 7/1998 | Brandle et al. | 122/6 |

FOREIGN PATENT DOCUMENTS

| | | |
|---|---|---|
| DE | 1 198 480 | 8/1965 |
| EP | 0 135 664 | 5/1984 |
| EP | 0 481 483 | 10/1991 |
| FR | 1416901 | 12/1964 |

OTHER PUBLICATIONS

PCT International Search Report dated Mar. 8, 2004, issued in corresponding PCT patent appln. No. PCT/IB 03/06088.

* cited by examiner

*Primary Examiner*—Henry Bennett
*Assistant Examiner*—Tho Duong
(74) *Attorney, Agent, or Firm*—Fitzpatrick, Celia, Harper & Scinto

(57) ABSTRACT

A vertical polygonal heat exchange chamber includes an upper opening, a lower opening, and an enclosure formed between the upper and lower openings. The enclosure includes at least one tapered portion that narrows in a direction toward one of the openings. The tapered portion is lined with N first water tube panels arranged adjacent to and alternately with N second water tube panels, where N is an integer greater than two. Each of the first and second water tube panels is angled inwardly from the widest part of the tapered portion toward the interior of the enclosure, with each of the first water tube panels being angled inwardly to a greater degree than each of the second water tube panels.

43 Claims, 1 Drawing Sheet

POLYGONAL HEAT EXCHANGE CHAMBER INCLUDING A TAPERED PORTION LINED WITH WATER TUBE PANELS AND METHOD OF LINING A TAPERED PORTION OF A POLYGONAL HEAT EXCHANGE CHAMBER WITH SUCH PANELS

BACKGROUND OF THE INVENTION

1. Field of the Invention

My invention relates to a vertical polygonal heat exchange chamber having at least one tapered portion that is lined, in a novel way, with water tube panels. My invention also relates to a novel method of lining a tapered portion of a vertical polygonal heat exchange chamber with such panels.

2. Description of the Related Art

In polygonal chambers having at least one tapered portion that narrows toward an opening of the chamber, it is difficult to line the tapered portion with water tube panels in an industrially, economically, and operationally efficient manner. Such chambers may be used, for example, for recovering heat from flue gases or from suspensions of flue gases and solids, such as in cooled polygonal cyclones of fluidized bed boilers.

European Patent Publication No. 0 481 438, U.S. Pat. Nos. 4,576,120, and 5,775,265 disclose several conventional ways of lining a tapered lower portion of a four-sided heat exchange chamber with water tube panels.

European Patent Publication No. 0 481 438 discloses a centrifugal separator operating as a heat exchange chamber and having a funnel-shaped lower portion lined with water tube panels. The centrifugal separator has a rectangular horizontal cross section, and the funnel-shaped lower portion of the separator is formed by bending one or both of two opposite panel walls inwardly. The other panel walls, meanwhile, are uniform in width and extend vertically downward to the lower edge of the tapered portion, where they are connected with horizontal headers or manifolds.

U.S. Pat. No. 4,576,120 discloses a heat exchanger having a similar construction to the centrifugal separator disclosed in European Patent Publication No. 0 481 438, except that portions of the vertical wall panels extending beyond the side edges of the inwardly-bending wall panels connect to horizontal headers, which are arranged in steps.

U.S. Pat. No. 5,775,265 relates to a cooling surface cladding for a polygonal chamber of a steam generator. The chamber has a rectangular horizontal cross section and is lined with a plurality of tube walls. The bottom portion of the chamber is tapered, with first and second pairs of opposite tube walls sequentially being angled inwardly. The tube walls are tapered continuously and are connected to a plurality of inclined headers.

As those skilled in the art will appreciate, the foregoing approaches are not readily adaptable for lining heat exchange chambers having more than four sides, such as hexagonal or octagonal chambers. Moreover, the inclination of the headers in the '265 patent can cause problems if the headers contain a mixture of steam and liquid water, in which case the steam and liquid water may be unevenly diverted to separate portions of the headers.

SUMMARY OF THE INVENTION

My invention provides a novel, efficient way of lining a tapered portion of a vertical polygonal heat exchange chamber having more than four sides with simple water tube panels which are inexpensive to manufacture such that the various tapered portions may simultaneously taper inwardly in more than one horizontal direction and that the widths of all water tube panels remain substantially uniform in the tapered portions.

In one aspect, my invention relates to a vertical polygonal heat exchange chamber including an upper opening, a lower opening, and an enclosure formed between the upper and lower openings. The enclosure includes at least one tapered portion that narrows in a direction toward one of the openings. The tapered portion is lined with N first water tube panels arranged adjacent to and alternately with N second water tube panels, where N is an integer greater than two. Each of the first and second water tube panels is angled inwardly from the widest part of the tapered portion toward the interior of the enclosure, with each of the first water tube panels being angled inwardly to a greater degree than each of the second water tube panels.

The heat exchange chamber according to this aspect of my invention may also include a vertically-extending portion contiguous with the tapered portion. The vertically-extending portion has a substantially uniform horizontal cross section and is lined with a plurality of vertical or substantially vertical water tube panels that comprises generally vertical extensions of the first and second water tube panels that line the tapered portion.

The inner surface of each second water tube panel (i.e., the surface facing the interior of the enclosure) is joined, preferably by welding, to respective side edges of the two first water tube panels adjacent to that panel. In that way, the first and second water tube panels form a gas-tight enclosure for the tapered portion.

Each of the first and second water tube panels preferably includes a plurality of individual water tubes. The spacing between each water tube preferably is substantially constant within each of the first and second water tube panels. However, the spacing between individual tubes in different panels can vary. For example, the spacing between the tubes in the first water tube panels can be different from the spacing between the tubes in the second water tube panels. Each of the first and second water tube panels preferably is substantially uniform in width. According to a preferred embodiment, all panels of the water tube panel lining in the tapered portion of the heat exchange chamber are of equal width. Alternatively, the water tube panels can have different widths, with the second water tube panels being wider than the first water tube panels, for example. In either case, the water tube panels are planar or substantially planar.

At the level where the tapered portion is narrowest, respective side edges of each pair of adjacent first water tube panels can be joined to form one of the openings of the chamber. The first water tube panels can extend vertically beyond the opening to form a vertically-extending end channel for discharging separated particles from the chamber, for example.

The individual water tubes of the first water tube panels can be connected at the end edges of the panels to a common header at the level where the tapered portion is narrowest. Similarly, the water tubes of the second water tube panels can be connected at the end edges of the panels to a different common header. If necessary, the water tube panels can be angled outwardly away from the interior of the enclosure before the water tubes are connected to their respective headers. According to a preferred embodiment, each header is arranged parallel to a substantially horizontal plane.

The heat exchange chamber can be provided with a tapered portion lined with water tube panels, as described above, near one or both of its ends. Each tapered portion tapers inwardly simultaneously in more than one horizontal direction in such a way that the width of each water tube panel remains substantially uniform.

In the heat exchange chamber according to the present invention, the lining of the tapered portion is formed by a simple and easy method using simple water tube panels which are inexpensive to manufacture. Because the width of each panel in the tapered portion of the heat exchange chamber is substantially uniform, problems caused by tubes of different lengths are avoided.

Advantageously, any headers are arranged parallel to a substantially horizontal plane. That way, problems associated with the use of inclined headers are avoided. For example, if a horizontal or approximately horizontal header contains a mixture of steam and liquid water, such mixture will be evenly distributed throughout the header, whereas in an inclined header, the steam and liquid water may tend to flow toward different portions of the header. Furthermore, the use of horizontal or approximately horizontal headers facilitates the even distribution of the heat exchange medium (e.g., liquid water, steam, or a mixture thereof) to the individual water tubes of the panels. Furthermore, the number of the headers can be minimized, because in each of the panels all tubes are of the same length and when so desired, the tubes of different panels may be joined to the same header.

The present invention provides a simple way to line a heat exchange chamber throughout with water tube panels. Thus, it provides a way to avoid thick refractory coated portions of such chambers and problems related, e.g., to the durability of such structures.

According to the invention, the heat exchange chamber may be a heat exchange chamber for recovering heat from flue gases or from a suspension of flue gases and solids. In a preferred embodiment, the heat exchange chamber is part of a fluidized bed reactor, especially the body of a cyclone of a fluidized bed reactor.

In another aspect, my invention relates to a vertical polygonal heat exchange chamber again including an upper opening, a lower opening, and an enclosure formed between the upper and lower openings. In this aspect, however, the enclosure includes (i) a first portion having a number of vertically-extending sides equal to two times N, where N is an integer greater than two, and (ii) a tapered second portion, contiguous with the first portion, that narrows in a direction leading away from the first portion. The second portion is lined with N first water tube panels arranged adjacent to and alternately with N second water tube panels. Each of the first and second water tube panels is angled inwardly from the widest part of the second portion toward the interior of the enclosure, with each of the first water tube panels being angled inwardly to a greater degree than each of the second water tube panels.

In still another aspect, my invention relates to a method of lining a tapered portion of a vertical polygonal heat exchange chamber with a number of water tube panels equal to two times N, where N is an integer greater than two. The method includes steps of (i) arranging N first water tube panels adjacent to and alternately with N second water tube panels, and (ii) angling each of the first and second water tube panels inwardly from the widest part of the tapered portion toward the interior of the heat exchange chamber, with each of the first water tube panels being angled inwardly to a greater degree than each of the second water tube panels.

BRIEF DESCRIPTION OF THE DRAWINGS

The above brief description, as well as further features and advantages of my invention, will be more fully appreciated by reference to the following detailed description of a presently preferred, but merely illustrative, embodiment of the invention, taken in conjunction with accompanying FIG. 1, which schematically illustrates a heat exchange chamber in accordance with a preferred embodiment of my invention.

DESCRIPTION OF THE PREFERRED EMBODIMENTS

Figure 1:
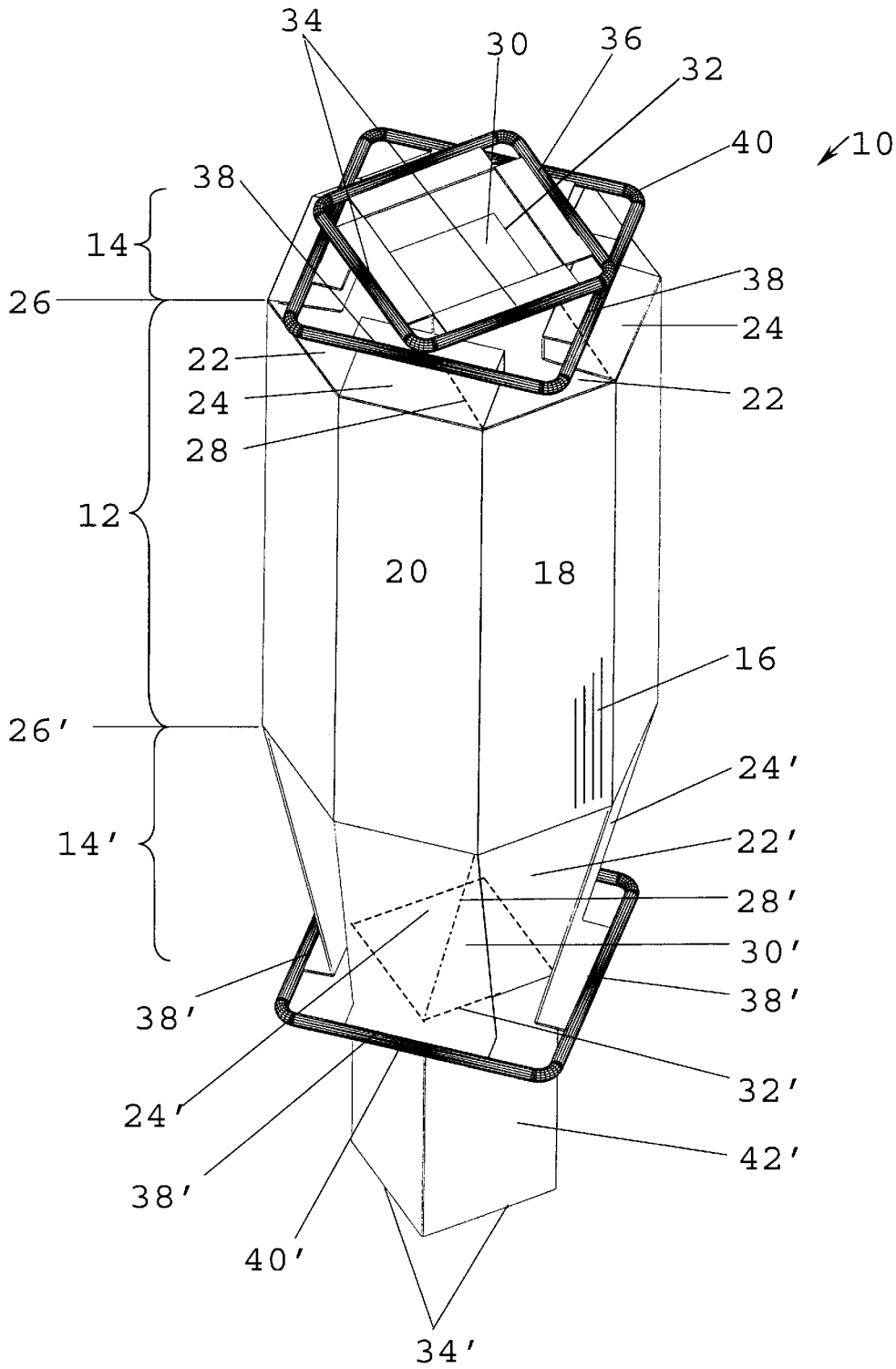

FIG. 1 illustrates a heat exchange chamber for recovering heat from a suspension of flue gases and solids in accordance with a preferred embodiment of my invention. In this preferred embodiment, the heat exchange chamber comprises an octagonal cyclone body 10 of a fluidized bed boiler. The cyclone body 10 includes an upper opening 30, a lower opening 30', and an enclosure formed between the upper and lower openings. The enclosure comprises a vertically-extending central portion 12 having a uniform horizontal cross section that is disposed between and contiguous with two tapered portions 14, 14', each of which narrows in a direction toward a respective one of the openings 30, 30' of the cyclone body 10.

The central portion 12 and the tapered portions 14, 14', of the cyclone body 10 are lined with conventional water tube panels, each comprising a plurality of individual water tubes 16 welded together by means of narrow metal plates (not shown). Preferably, the water tube panels are of substantially uniform width, and the spacing of the tubes 16 is substantially constant. In FIG. 1, only a few water tubes 16 are illustrated, for clarity. In FIG. 1, all water tube panels of the cyclone body 10 are also of equal width.

In this preferred embodiment, eight substantially vertical, planar or substantially planar water tube panels 18, 20 line the central portion 12 of the cyclone body 10. The water tube panel linings of the tapered portions 14, 14', meanwhile, are formed by bending extensions 22, 22', 24, 24' of the water tube panels 18, 20 inwardly at junctions 26, 26' where the central portion 12 transitions to the tapered portions 14, 14'.

The water tube panel linings of the tapered portions 14, 14' are formed of four first water tube panels 22, 22' arranged adjacent to and alternately with four second water tube panels 24, 24'. The water tube panels 22, 22', 24, 24' are angled inwardly from the widest parts 26, 26' of the tapered portions 14, 14' in such a way that each first water tube panel 22, 22' forms an angle with the vertical direction that is greater than the angle formed between each second water tube panel 24, 24' and the vertical direction. In other words, each of the first water tube panels 22, 22' is angled inwardly to a greater degree than each of the second water tube panels 24, 24'.

By angling the water tube panels 22, 22', 24, 24' in this manner, the inner surface of each second water tube panel 24, 24' (i.e., the surface facing the interior of the cyclone body 10) can be joined, preferably by welding, to respective side edges 28, 28' of the two adjacent first water tube panels in order to form a gas-tight enclosure for the tapered portions 14, 14'.

As shown in FIG. 1, the first water tube panels 22, 22' that line the tapered portions 14, 14' of the cyclone body 10 are angled in such a way that the side edges 28, 28' of adjacent first water tube panels 22, 22' meet at the openings 30, 30' of the cyclone body 10 to form square-shaped passages 32, 32'.

In this preferred embodiment, the individual water tubes of the first water tube panels 22 are connected to a common header 36 at the end edges 34 of the panels 22. Similarly, the water tubes of the second water tube panels 24 are connected to a common header 40 at the end edges 38 of the panels. The water tube panels 22, 24 preferably are angled outwardly away from the interior of the cyclone body 10 before the water tubes are connected to the headers 36, 40.

The first water tube panels 22' extend vertically beyond the lower opening 30' of the cyclone body 10 to form a vertically-extending end channel 42'. The water tubes of the extensions of the first water tube panels 22', which act as the walls of the end channel 42', can be connected at the end edges 34' of the panel extensions to a common header (not shown). Alternatively, the water tubes of the panel extensions can be connected at the end edges 34' of the panel extensions to different headers of the fluidized bed boiler.

Meanwhile, the water tubes of the second water tube panels 24' of the cyclone body 10 are connected at the end edges 38' of the panels 24' to a common header 40'. In this embodiment, the second water tube panels 24' are angled outwardly before the water tubes are connected to the header 40'.

Advantageously, the headers 36, 40, 40' lie parallel to a substantially horizontal plane. By arranging the headers horizontally, problems caused by the use of inclined headers are avoided. For example, if the horizontal headers contain heat transfer medium comprising of a mixture of steam and liquid water, such mixture will be evenly distributed throughout each header, unlike in an inclined header, where the steam and liquid water may tend to separate and flow toward different portions of the header. Moreover, horizontal headers facilitate the even distribution of the liquid water, steam, or mixture thereof to the different water tubes of the panels.

The cyclone body 10 illustrated in FIG. 1 is formed of planar or substantially planar water tube panels 18, 20, 22, 22', 24, 24' of equal width. Alternatively, the water tube panels 18, 20, 22, 22', 24, 24' may have varying widths. For example, the first water tube panels 22, 22' could be narrower than the second water tube panels 24, 24'.

My invention thus enables the tapered portions 14, 14', of the cyclone body 10 to be lined in a relatively simple and economical manner with panels which are inexpensive to manufacture. Moreover, although the cyclone body 10 illustrated in FIG. 1 has eight sides, my invention can be utilized with any polygonal chamber having two times N sides, where N is an integer greater than two. In such cases, the water tube panel linings of the tapered portion(s) are formed by arranging N first water tube panels adjacent to and alternately with N second tube panels. Each of the first and second water tube panels then is angled inwardly from the widest part of the tapered portion toward the interior of the chamber, with each of the first water tube panels being angled inwardly to a greater degree than each of the second water tube panels.

Those skilled in the art will appreciate that my invention is applicable to many different polygonal chambers, and not just to heat exchange chambers of the type specifically described and illustrated herein. A few of the many possible variations are briefly mentioned below.

For instance, although the cyclone body 10 shown in FIG. 1 has two lined tapered portions 14, 14'; it could also have just one tapered portion. In that case, one end of the chamber could be manufactured utilizing some other principle, for example it could simply be a partly uncooled structure.

In another possible embodiment, the first water tube panels 22 could extend vertically beyond the upper opening 30 of the cyclone body 10 to form a vertically-extending end channel (not shown), similar to the end channel 42' that extends below the lower opening 30' of the cyclone body 10. Alternatively, the cyclone body 10 could be constructed without any end channels.

Still another possibility is that the water tubes of the various water tube panels could be connected at the end edges of the panels to their own headers, as opposed to common headers, or perhaps to main headers of the fluidized bed boiler. It is also possible for the water tubes of the first water tube panels 22' to be connected at the end edges 34' of the panels to a common header. It is even possible for all of the water tubes of the various water tube panels to be connected to one header, if desired.

While the invention has been herein described by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

I claim:

1. A vertical polygonal heat exchange chamber, comprising:

an upper opening;

a lower opening; and an enclosure formed between the upper and lower openings, the enclosure including at least one tapered portion that narrows in a direction toward one of the openings, the tapered portion being lined with N first water tube panels arranged adjacent to and alternately with N second water tube panels, where N is an integer greater than two, each of the first and second water tube panels being angled inwardly from the widest part of the tapered portion toward the interior of the enclosure, wherein each of the first water tube panels is angled inwardly to a greater degree than each of the second water tube panels.

2. The heat exchange chamber of claim 1, wherein the enclosure further includes a vertically-extending portion contiguous with the tapered portion, the vertically-extending portion having a substantially uniform horizontal cross section and being lined with a plurality of vertical or substantially vertical water tube panels that comprises generally vertical extensions of the first and second water tube panels that line the tapered portion.

3. The heat exchange chamber of claim 1, wherein the surface of each second water tube panel facing the interior of the enclosure is joined to respective side edges of the two adjacent first water tube panels.

4. The heat exchange chamber of claim 1, wherein each of the first and second water tube panels comprises a plurality of individual water tubes.

5. The heat exchange chamber of claim 4, wherein the spacing between each water tube is substantially constant for each of the first and second water tube panels.

6. The heat exchange chamber of claim 4, wherein each of the first and second water tube panels is substantially uniform in width.

7. The heat exchange chamber of claim 4, wherein at the level where the tapered portion is narrowest, the water tubes of the first water tube panels are connected to a common header.

8. The heat exchange chamber of claim 7, wherein each of the first water tube panels is angled outwardly away from the interior of the enclosure before the water tubes are connected to the common header.

9. The heat exchange chamber of claim 7, wherein the common header lies parallel to a substantially horizontal plane.

10. The heat exchange chamber of claim 4, wherein at the level where the tapered portion is narrowest, the water tubes of the second water tube panels are connected to a common header.

11. The heat exchange chamber of claim 10, wherein each of the second water tube panels is angled outwardly away from the interior of the enclosure before the water tubes are connected to the common header.

12. The heat exchange chamber of claim 10, wherein the common header lies parallel to a substantially horizontal plane.

13. The heat exchange chamber of claim 1, wherein the first and second water tube panels are planar or substantially planar.

14. The heat exchange chamber of claim 1, wherein at the level where the tapered portion is narrowest, respective side edges of each pair of adjacent first water tube panels are joined to define one of the openings.

15. The heat exchange chamber of claim 14, wherein the first water tube panels extend vertically beyond the opening to form a vertically-extending end channel.

16. The heat exchange chamber of claim 1, wherein the enclosure includes two tapered portions, each narrowing in a direction toward a respective one of the openings, each tapered portion being lined with N first water tube panels arranged adjacent to and alternately with N second water tube panels, where N is an integer greater than two, and each of the first and second water tube panels being angled inwardly from the widest part of the respective tapered portion toward the interior of the enclosure, wherein each of the first water tube panels is angled inwardly to a greater degree than each of the second water tube panels.

17. A fluidized bed reactor including the heat exchange chamber of claim 1.

18. A vertical polygonal heat exchange chamber, comprising:

an upper opening;

a lower opening; and an enclosure formed between the upper and lower openings, the enclosure including (i) a first portion having a number of vertically-extending sides equal to two times N, where N is an integer greater than two, and (ii) a tapered second portion, contiguous with the first portion, that narrows in a direction leading away from the first portion, the second portion being lined with N first water tube panels arranged adjacent to and alternately with N second water tube panels, each of the first and second water tube panels being angled inwardly from the widest part of the second portion toward the interior of the enclosure, wherein each of the first water tube panels is angled inwardly to a greater degree than each of the second water tube panels.

19. The heat exchange chamber of claim 18, wherein the first portion of the enclosure has a uniform horizontal cross section and is lined with a plurality of vertical or substantially vertical water tube panels that comprises generally vertical extensions of the first and second water tube panels that line the second portion of the enclosure.

20. The heat exchange chamber of claim 18, wherein the surface of each second water tube panel facing the interior of the enclosure is joined to respective side edges of the two adjacent first water tube panels.

21. The heat exchange chamber of claim 18, wherein each of the first and second water tube panels comprises a plurality of individual water tubes.

22. The heat exchange chamber of claim 21, wherein the spacing between each water tube is substantially constant for each of the first and second water tube panels.

23. The heat exchange chamber of claim 21, wherein each of the first and second water tube panels is substantially uniform in width.

24. The heat exchange chamber of claim 21, wherein at the level where the second portion of the enclosure is narrowest, the water tubes of the first water tube panels are connected to a common header.

25. The heat exchange chamber of claim 24, wherein each of the first water tube panels is angled outwardly away from the interior of the enclosure before the water tubes are connected to the common header.

26. The heat exchange chamber of claim 24, wherein the common header lies parallel to a substantially horizontal plane.

27. The heat exchange chamber of claim 21, wherein at the level where the second portion of the enclosure is narrowest, the water tubes of the second water tube panels are connected to a common header.

28. The heat exchange chamber of claim 27, wherein each of the second water tube panels is angled outwardly away from the interior of the enclosure before the water tubes are connected to the common header.

29. The heat exchange chamber of claim 27, wherein the common header lies parallel to a substantially horizontal plane.

30. The heat exchange chamber of claim 18, wherein the first and second water tube panels are planar or substantially planar.

31. The heat exchange chamber of claim 18, wherein at the level where the second portion of the enclosure is narrowest, respective side edges of each pair of adjacent first water tube panels are joined to define one of the openings.

32. The heat exchange chamber of claim 31, wherein the first water tube panels extend vertically beyond the opening to form a vertically-extending end channel.

33. The heat exchange chamber of claim 18, wherein the enclosure further includes a tapered third portion, contiguous with the first portion and on a side of the first portion opposite from the second portion, the third portion narrowing in a direction leading away from the first portion, the second portion being lined with N third water tube panels arranged adjacent to and alternately with N fourth water tube panels, and each of the third and fourth water tube panels being angled inwardly from the widest part of the third portion toward the interior of the enclosure, wherein each of the third water tube panels is angled inwardly to a greater degree than each of the fourth water tube panels.

34. A fluidized bed reactor including a heat exchange chamber according to claim 18.

35. A method of lining a tapered portion of a vertical polygonal heat exchange chamber with a number of water tube panels equal to two times N, where N is an integer greater than two, the method comprising the following steps:

arranging N first water tube panels adjacent to and alternately with N second water tube panels; and angling each of the first and second water tube panels inwardly from the widest part of the tapered portion toward the interior of the heat exchange chamber, wherein each of the first water tube panels is angled inwardly to a greater degree than each of the second water tube panels.

36. The method of claim 35, further comprising a step of joining the surface of each second water tube panel facing the interior of the heat exchange chamber to respective side edges of the two adjacent first water tube panels.

37. The method of claim 35, further comprising a step of joining respective side edges of each pair of adjacent first water tube panels, at the level where the tapered portion is narrowest, to form a closed configuration.

38. The method of claim 35, further comprising a step of connecting an end edge of each of the first water tube panels, at the level where the tapered portion is narrowest, to a common header, such that the individual water tubes that comprise the first water tube panels are in flow communication with the common header.

39. The method of claim 38, further comprising a step of angling each of the first water tube panels outwardly away from the interior of the heat exchange chamber before connecting the end edge of each of the first water tube panels to the common header.

40. The method of claim 38, further comprising a step of orienting the common header such that it is parallel to a substantially horizontal plane.

41. The method of claim 35, further comprising a step of connecting an end edge of each of the second water tube panels, at the level where the tapered portion is narrowest, to a common header, such that the individual water tubes that comprise the second water tube panels are in flow communication with the common header.

42. The method of claim 41, further comprising a step of angling each of the second water tube panels outwardly away from the interior of the heat exchange chamber before connecting the end edge of each of the second water tube panels to the common header.

43. The method of claim 41, further comprising a step of orienting the common header such that it is parallel to a substantially horizontal plane.

* * * * *